US012560368B2

(12) United States Patent
Pirovano et al.

(10) Patent No.: US 12,560,368 B2
(45) Date of Patent: Feb. 24, 2026

(54) HUMIDITY MEMBRANE AND HUMIDITY/MOISTURE CONTROL FOR A CRISPER DRAWER

(71) Applicant: WHIRLPOOL CORPORATION, Benton Harbor, MI (US)

(72) Inventors: Maria Paola Pirovano, Molteno (IT); Muhammad Khizar, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 320 days.

(21) Appl. No.: 18/347,085

(22) Filed: Jul. 5, 2023

(65) Prior Publication Data

US 2025/0012503 A1 Jan. 9, 2025

(51) Int. Cl.

| | |
|---|---|
| ***F25D 17/04*** | (2006.01) |
| ***F25D 23/08*** | (2006.01) |
| ***F25D 25/02*** | (2006.01) |

(52) U.S. Cl.

CPC ..... *F25D 17/042* (2013.01); *F25D 23/087* (2013.01); *F25D 25/025* (2013.01); *F25D 2317/04131* (2013.01)

(58) Field of Classification Search

CPC .... F25D 17/042; F25D 23/087; F25D 25/025; F25D 2317/04131

See application file for complete search history.

(56) References Cited

U.S. PATENT DOCUMENTS

| | | | | |
|---|---|---|---|---|
| 2,679,077 | A * | 5/1954 | Immel | F25D 23/087 49/490.1 |
| 5,830,360 | A | 11/1998 | Mozayeni | |
| 5,918,480 | A * | 7/1999 | Nagata | F25D 17/042 215/310 |
| 7,401,469 | B2 * | 7/2008 | Joshi | F25D 17/042 62/176.1 |
| 7,845,181 | B2 | 12/2010 | Evans et al. | |
| 8,998,177 | B2 * | 4/2015 | Wang | A23B 7/148 261/78.2 |
| 9,737,675 | B2 * | 8/2017 | Frame | A61M 16/1075 |
| 10,612,829 | B2 * | 4/2020 | Carballo | F25D 17/042 |

(Continued)

FOREIGN PATENT DOCUMENTS

| | | | | |
|---|---|---|---|---|
| CN | 115164311 | A * | 10/2022 | F24F 11/89 |
| DE | 102013225541 | A1 * | 6/2015 | F25D 25/025 |
| WO | 2013/177928 | A1 | 12/2013 | |

OTHER PUBLICATIONS

English Machine translation of a portion of the description of CN-115164311-A (Year: 2022).*

*Primary Examiner* — Nathan C Zollinger
(74) *Attorney, Agent, or Firm* — Brooks Kushman P.C.

(57) ABSTRACT

An appliance includes a housing defining an interior cabinet; and a crisper drawer disposed within the interior cabinet. The crisper drawer includes a base, walls, and lid to define a cavity for receiving food items to be stored in the crisper drawer. The lid selectively closes the crisper drawer to limit air flow to and from the cavity. One or more of the base, the walls, and the lid define an opening and include a humidity membrane disposed within the opening. The humidity membrane includes a seal therearound for sealing the opening, wherein the seal of the humidity membrane retains moisture and limits leakage of humidity from the crisper drawer.

12 Claims, 5 Drawing Sheets

(56) References Cited

U.S. PATENT DOCUMENTS

| | | | | |
|---|---|---|---|---|
| 11,543,175 | B2 * | 1/2023 | Butenhoff | F25D 25/025 |
| 2006/0130498 | A1 * | 6/2006 | Joshi | F25D 17/042 62/176.1 |
| 2019/0293342 | A1 | 9/2019 | Butenhoff et al. | |
| 2022/0305757 | A1 * | 9/2022 | Khizar | B32B 5/024 |

* cited by examiner

HUMIDITY MEMBRANE AND HUMIDITY/MOISTURE CONTROL FOR A CRISPER DRAWER

TECHNICAL FIELD

The present application is directed to a membrane for a refrigeration appliance, and more particularly a humidity membrane and humidity control system for a crisper drawer of a refrigeration appliance.

BACKGROUND

Appliances, such as refrigeration appliances, conventionally include various shelves and drawers within the cabinet area of the appliance. In order to keep food fresh, crisper drawers are utilized to create compartments for retaining moisture and creating a more humid environment than the rest of the cabinet area where air is circulating.

SUMMARY

According to one or more embodiments, an appliance includes a housing defining an interior cabinet; and a crisper drawer disposed within the interior cabinet. The crisper drawer includes a base, walls, and lid to define a cavity for receiving food items to be stored in the crisper drawer. The lid selectively closes the crisper drawer to limit air flow to and from the cavity. One or more of the base, the walls, and the lid define an opening and include a humidity membrane disposed within the opening. The humidity membrane includes a seal therearound for sealing the opening, wherein the seal of the humidity membrane retains moisture and limits leakage of humidity from the crisper drawer.

According to at least one embodiment, the seal may be formed of gasket material. In at least one further embodiment, the gasket material may be a food-safe neoprene, nitrile (Buna-N), ethylene propylene diene Monomer (EPDM), silicone rubber, flexible PVC, or combinations thereof. In one or more embodiments, the appliance may further comprise a circulation system cooperating with the humidity membrane, the circulation system including one or more fans disposed within the crisper drawer to selectively facilitate air flow across the humidity membrane and mix air within the cavity to control a humidity level within the crisper drawer. In at least one further embodiment, the circulation system may further include a controller configured to, responsive to the humidity level within the crisper drawer falling below a predetermined humidity level, actuate the one or more fans to promote air flow toward the humidity membrane to increase the humidity level in the crisper drawer. In some further embodiments, the predetermined humidity level may be 55% humidity. According to one or more embodiments, the appliance may further include a mist system including a mist device and a water source, with the mist device being disposed in the crisper drawer to produce moisture from the water source within crisper drawer. In at least one further embodiment, responsive to a moisture level within the crisper drawer falling below a predetermined moisture level, a controller may actuate the mist system to draw water from the water source and generate mist at the mist device to increase moisture levels within the crisper drawer. In at least one other further embodiment, the appliance may further include a circulation system cooperating with the mist system, the circulation system including one or more fans disposed within the crisper drawer to selectively facilitate air flow across the humidity membrane and mix air with the moisture within the cavity to control a humidity level within the crisper drawer. In one or more embodiments, the humidity membrane may be a porous membrane having an average pore size 100 to 300 microns.

According to one or more embodiments, a compartment of an appliance includes a base, walls, and lid to defining a cavity for a crisper drawer for receiving food items to be stored in the crisper drawer. The lid selectively closes the crisper drawer to limit air flow to and from the cavity. One or more of the base, the walls, and the lid define an opening and include a humidity membrane disposed and sealed within the opening. The humidity membrane include a seal therearound for sealing the opening. The compartment also includes a mist system including a mist device and a water source fluidly connected to the mist device. The mist device is disposed within the cavity of the crisper drawer, and produces a moisture spray from water from the water source to increase a moisture level within the crisper drawer.

According to at least one embodiment, responsive to the moisture level falling below a predetermined threshold moisture level, a controller may actuate the mist system to generate mist within the crisper drawer from water provided at the water source. In at least one embodiment, the compartment may further include a circulation system including at least one fan disposed within the crisper drawer to facilitate air flow within the cavity and across the humidity membrane to selectively control a humidity level within the crisper drawer. In at least one further embodiment, responsive to the humidity level within the cavity of the crisper drawer falling below a predetermined threshold humidity level and a moisture level falling below a predetermined moisture level, a controller may actuate the circulation system and the mist system to form the moisture and humidify the air within the crisper drawer. According to a further embodiment, responsive to the humidity level within the crisper drawer falling below a predetermined threshold humidity level and the moisture level exceeding the predetermined moisture level, the controller may actuate only the circulation system to mix air within the crisper drawer to raise the humidity level above the predetermined threshold humidity level. According to at least one embodiment, the seal may be formed of a gasket material. In some further embodiments, the gasket material may be a food-safe neoprene, nitrile (Buna-N), ethylene propylene diene Monomer (EPDM), silicone rubber, flexible PVC, or combinations thereof.

According to one or more embodiments, a system for controlling humidity within a crisper drawer of an appliance includes a humidity membrane sealed by a seal in an opening of a body of the crisper drawer, with the humidity membrane facilitating air flow from a cavity of the crisper drawer to an interior cabinet of the appliance and the seal limiting humidity leakage from the opening, a circulation system, a mist system, and a controller. The circulation system is disposed within the cavity of the crisper drawer, and includes a fan configured to promote airflow within the cavity when actuated. The mist system is disposed within the cavity and in fluid communication with a water source, and includes a mist device to produce a moisture spray in the cavity. The controller is configured to actuate the circulation system and promote air flow responsive to a humidity level within the crisper drawer, and actuate the mist system and produce moisture responsive to a moisture level within the crisper drawer. When the humidity level is below a threshold humidity level and the moisture level is below a threshold moisture level, the controller actuates both the circulation system and the mist system to increase the humidity level and moisture level, respectively.

According to at least one embodiment, responsive to the moisture level within the crisper drawer being above the threshold moisture level, and the humidity level being below the threshold humidity, the controller may deactivate the mist system and continue operation of the circulation system. In one or more embodiments, when the humidity level is below a first humidity threshold, the fan is actuated at a first setting, and when the humidity level is below a second humidity threshold, higher than the first, the controller may actuate the fan at a second setting, lower than the first setting.

DETAILED DESCRIPTION

Figure 1:
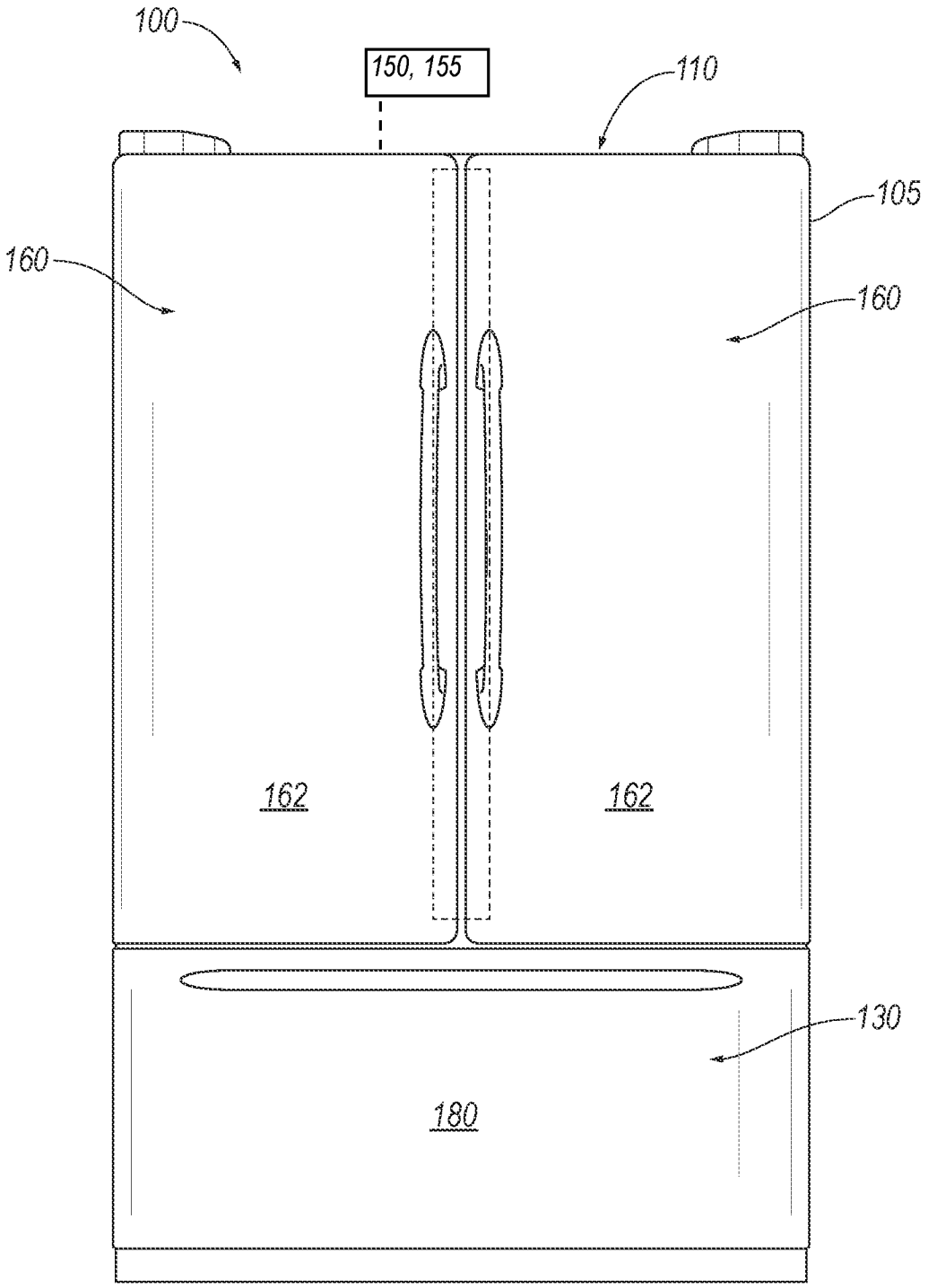
FIG. 1 is a schematic illustration of an appliance with doors in a closed position, according to one or more embodiments.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Moreover, except where otherwise expressly indicated, all numerical quantities and ranges in this disclosure are to be understood as modified by the word "about." Practice within the numerical limits stated is generally preferred. Also, unless expressly stated to the contrary, the description of a group or class of materials by suitable or preferred for a given purpose in connection with the disclosure implies that mixtures of any two or more members of the group or class may be equally suitable or preferred.

The term "substantially," "generally," or "about" may be used herein to describe disclosed or claimed embodiments. The term "substantially" may modify a value or relative characteristic disclosed or claimed in the present disclosure. In such instances, "substantially" may signify that the value or relative characteristic it modifies is within +0%. 0.1%, 0.5%, 1%, 2%, 3%, 4%, 5% or 10% of the value or relative characteristic.

It should also be appreciated that integer ranges explicitly include all intervening integers. For example, the integer range 1-10 explicitly includes 1, 2, 3, 4, 5, 6, 7, 8, 9, and 10. Similarly, the range 1 to 100 includes 1, 2, 3, 4 . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

"One or more" includes a function being performed by one element, a function being performed by more than one element, e.g., in a distributed fashion, several functions being performed by one element, several functions being performed by several elements, or any combination of the above.

According to one or more embodiments, an appliance, such as a refrigerator, includes a crisper drawer having a humidity membrane for facilitating humidity retention and humidity control in the crisper drawer cavity. High humidity (e.g., above 40% relative humidity) improves the shelf-life of fresh produce, such as fruits and green leafy vegetables, in refrigerator because the fresh produce creates moisture and needs a moisture rich environment for preservation. High humidity with relatively more moisture within the crisper drawer of a refrigerator can result in more moisture on the leaves of the produce, which in turn maintains the sturdiness and freshness of lettuce. The air flow provided to the interior cabinet by the evaporator is relatively low humidity, and thus control of the humidity level within the crisper drawer may be limited. Therefore, according to one or more embodiments, refrigeration appliances, and other appliances requiring high humidity compartments, are provided that include a humidity membrane and humidity control system for circulating air in the crisper drawer and for providing moisture production which together maintain a high humidity levels and increase moisture levels in the crisper drawer. In various embodiments, the humidity maintenance and leakage inhibition is provided via a non-toxic (i.e., food-safe) seal for the humidity membrane.

Figure 2:
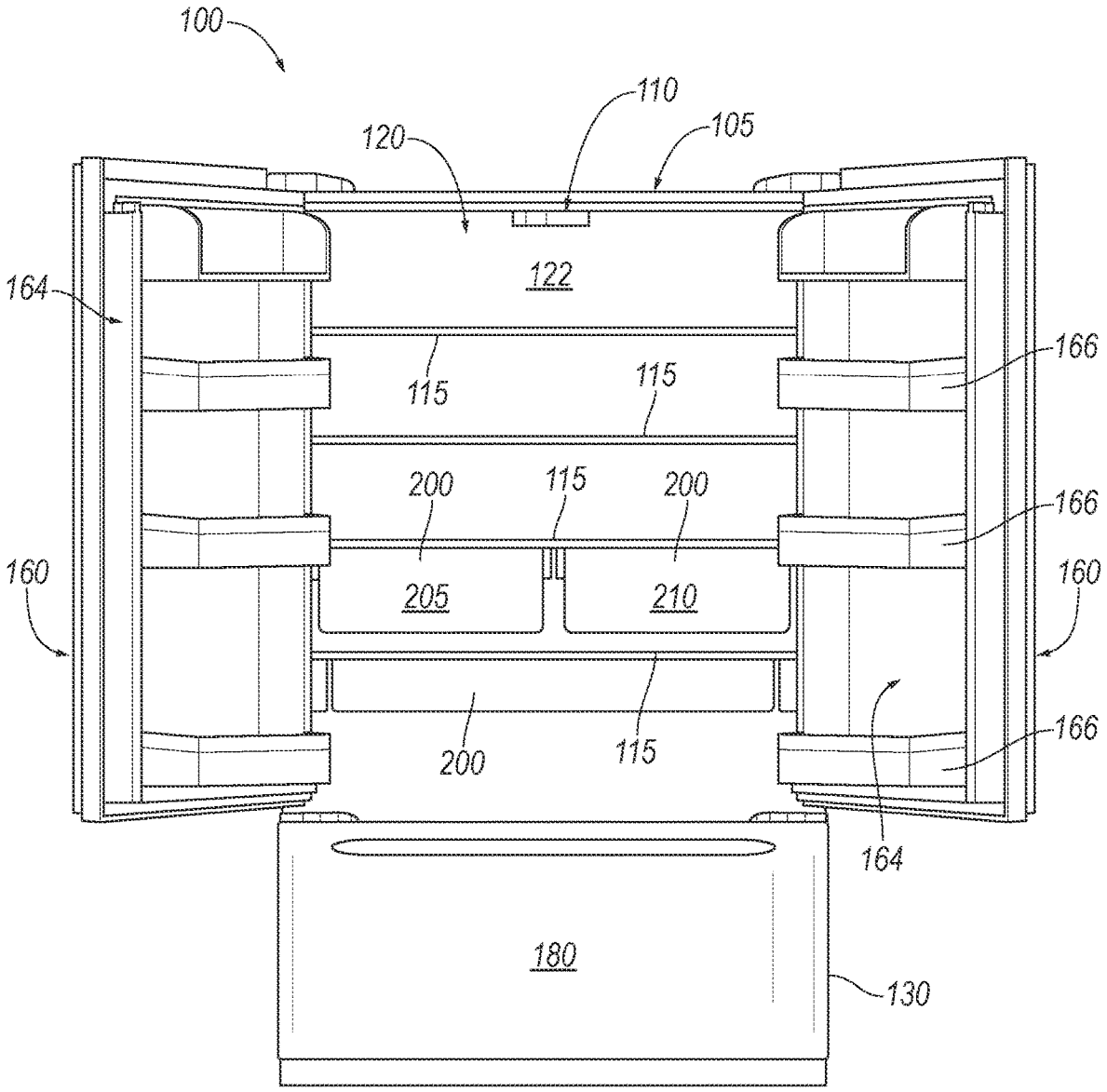
FIG. 2 shows the appliance of FIG. 1, with the doors in an open position.

Referring to FIGS. 1 & 2, an appliance 100 is shown according to an embodiment. The appliance 100 may be a refrigeration appliance as shown, however, appliance 100 may be any suitable appliance having compartments requiring humidity control, such as, but not limited to, a refrigerator, freezer, ice maker, dishwasher, washer, or dryer. Thus, the depiction or discussion of a refrigerator is not intended to be limiting, and appliance 100 may be referred to interchangeably with refrigerator 100. The appliance 100 of FIGS. 1 & 2 is generally shown as a French-Door Bottom Mount appliance. However, it should be understood that this is not intended to be limiting, and the appliance 100 may be any construction for a refrigerator or freezer appliance, such as a side-by-side, two-door bottom mount, or a top-mount type.

As shown in FIGS. 1 & 2, the refrigerator 100 includes external walls 105 defining a housing 110 with an interior cabinet 120 formed therein as a first internal storage chamber, internal cavity, or fresh food compartment (hereinafter used interchangeably) for refrigerating, and not freezing, consumables or foodstuffs stored within the cabinet 120. The external walls 105 and housing 110 further define a freezer compartment 130 (under the interior cabinet 120 in the example of FIGS. 1 & 2 showing a bottom-mount French Door construction), as a second internal storage chamber for freezing consumables or foodstuffs within the freezer compartment 130 during normal use. It is generally known that the freezer compartment 130 is typically kept at a temperature below the freezing point of water, and the interior cabinet 120 is typically kept at a temperature above the freezing point of water and generally below a temperature of from about 35° F. to about 50° F., more typically below about 38° F. Although not shown in the Figures, the refrigerator 100 may include a third pull-out compartment or any additional compartments. The compartments may be separate compartments within narrow cabinet sections or separate cabinet sections or sub-compartments accessible by opening an access door, for example, to access the interior volume of the interior cabinet 120. Thus, any configuration of a refrigerator/freezer combination or any other multiple zone refrigeration device is contemplated.

The interior cabinet 120 of the refrigerator 100 is defined by internal walls 122 that form the interior cabinet 120 for the fresh food compartment and the freezer compartment 130. The internal walls 122 may more specifically form an internal liner of the refrigerator 100. The internal walls 122 may include a rear or back wall, a top wall, a bottom wall, and two side walls, and may be formed of a liner system with insulation between the liner system and the external walls 105 for the appliance 100.

As shown in FIG. 2, the appliance 100 includes one or more shelves 115 within the interior cabinet 120. Each shelf 115 may be secured to the walls 122 within the interior cabinet 120. One or more drawers 200 may be slidably secured to the shelves 115, the internal walls 122, or to another surface within the interior cabinet 120. In various embodiments, each of the one or more drawers 200 may be slidably secured via tracks or rails to guide the drawer 200 from a stowed position to an open position. One or more of the drawers 200 may be either a pantry drawer 205 or a crisper drawer 210, and the location and sizing of pantry drawers and crisper drawers shown in FIG. 2 is not intended to be limiting, and other arrangements are also contemplated. A crisper drawer 210 may more specifically be a drawer defining a storage space that is kept at a desired humidity which may be different from the remainder of the interior cabinet 120, but that is optimal for maintaining freshness of fruits and vegetables stored within the crisper drawer.

Referring again to FIGS. 1 & 2, the refrigerator 100 may have one or more doors 160, 180 that provide selective access to the interior cabinet 120 of the refrigerator 100, where consumables may be stored. As shown, the interior cabinet 120 doors are designated 160, and the door for the freezer compartment 130 is designated 180. The doors 160 may be configured to transition between open positions (as shown in FIG. 2) and closed positions (as shown in FIG. 1), or be partially open such that one door 160 is open while the other remains closed. As such, as shown in FIG. 1, the doors 160 may cover an opening to the interior cabinet 120 in the closed position. As shown in FIG. 2, the doors 160 may provide access to the interior cabinet 120 via the opening in the open position. In various embodiments, the refrigerator 100 may be constructed with other door structures from the French door type shown, and as such, the refrigerator 100 may only have one door as opposed to two doors as illustrated, and may further include doors mounted within the doors in other embodiments to provide access to a sub-compartment (not shown) in the door. In the embodiment depicted in the Figures, the doors 160 may be rotatably secured to the housing 110 by one or more hinges. The doors 160 may each include an exterior panel 162 and an interior panel 164 that is disposed on an internal side of the respective exterior panel 162 of each door 160. The interior panels 164 may be configured to face the interior cabinet 120 when the doors 160 are in closed positions (see FIG. 1). The interior panel 164 may more specifically be a door liner, similar to the internal walls 122 forming the internal liner of the interior cabinet 120. An insulating material, such as an insulating foam, may be disposed between the exterior panel 162 and interior panel 164 of each door 160 in order reduce the heat transfer from the ambient surroundings and increase the efficiency of the refrigerator.

The doors 160 may also include storage bins 166 that are able to hold food items or containers. The storage bins 166 may be secured to the interior panels 164 of each door 160. Alternatively, the storage bins 166 may integrally formed within or defined by the interior panels 164 of each door 160. In yet another alternative, a portion of the storage bins 166 may be secured to the interior panels 164 of each door 160, while another portion of the storage bins 166 may be integrally formed within or defined by the interior panels 164 of each door 160. The storage bins 166 may include shelves (e.g., a lower surface upon, which a food item or container may rest upon) that extend from back and/or side surfaces of the interior panels 164 of each door 160.

In certain examples, although not shown in the Figures, the refrigerator 100 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray, which may be housed in the freezer compartment 130. The refrigerator 100 may also have a control board or controller that sends electrical signals to the one or more valves when prompted by a user that water is desired or if an ice making cycle is required.

Such a controller may be part of a larger control system and may be controlled by or may cooperate with various other controllers throughout the refrigerator 100, and one or more other controllers can collectively be referred to as a "controller 150" that controls various functions of the refrigerator 100 in response to inputs or signals from sensors 155 to control functions of the refrigerator 100. Various independent controllers are also contemplated. Each controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMS (electrically PROM), EEPROMs (electrically erasable PROM), flash memory, or any other electric, magnetic, optical, or combination memory devices capable of storing data, some of which represent executable instructions, used by the controller in controlling the refrigerator 100. In an example, the interior cabinet 120 and/or the freezer compartment 130 may have a controller 150 adjust air flow in order to alter the temperature within the compartment. In another non-limiting example, as will be described below, the controller may further, responsive to a humidity level or moisture level detection from one or more humidity and/or moisture sensors 155 lower than a predetermined amount in the crisper drawer, initiate a humidity control system 500 to increase humidity in the crisper drawer. The moisture level described herein is described as water content in liquid form as differentiable from the humidity within the crisper drawer.

Figure 3:
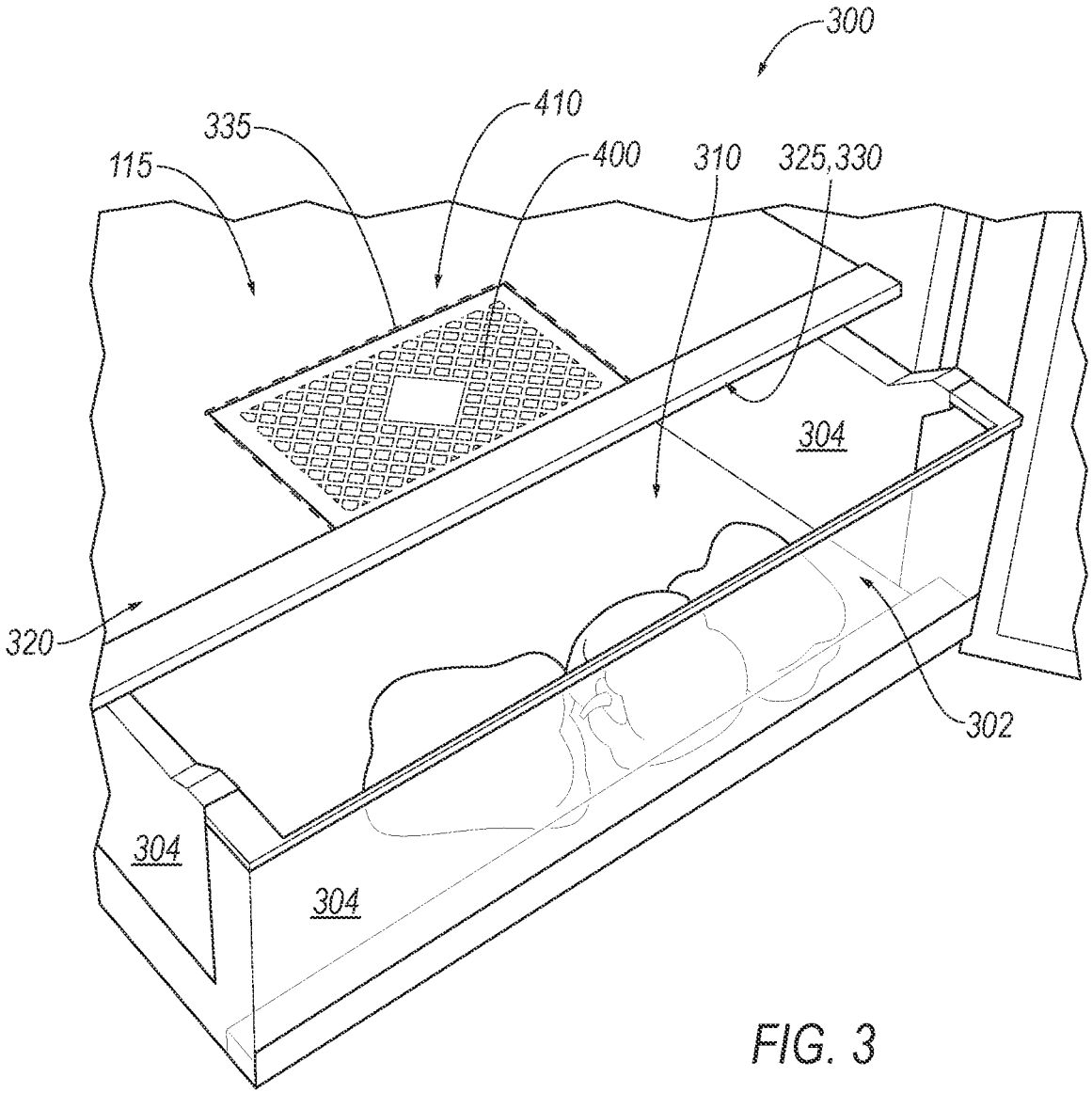
FIG. 3 is a schematic illustration of a crisper drawer, according to one or more embodiments.
Figure 4:
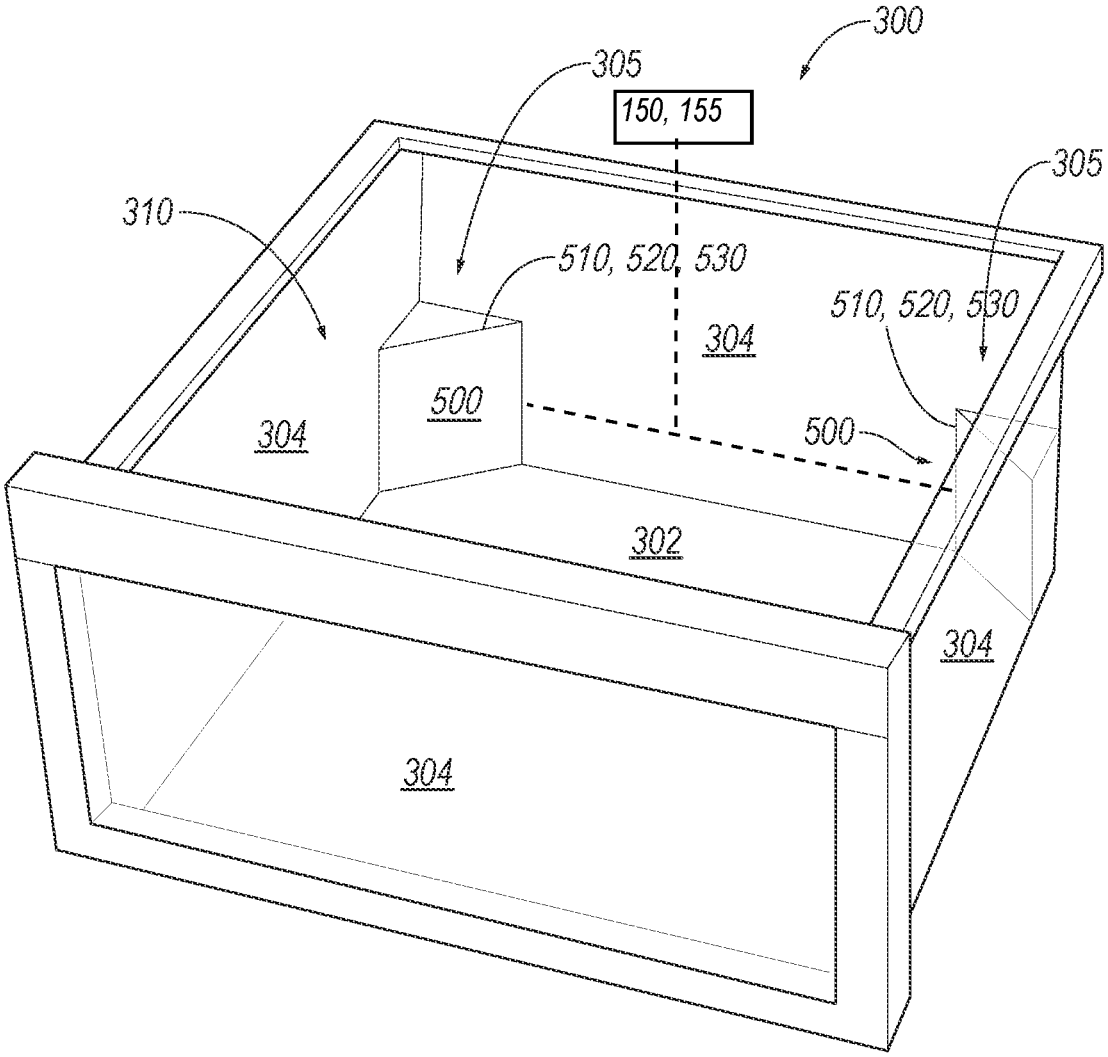
FIG. 4 is a schematic illustration of a crisper drawer with a humidity control system, according to one or more embodiments.

Referring to FIGS. 3 and 4, a crisper drawer 300 is shown according to one or more embodiments. The crisper drawer 300 includes a base 302 forming the floor of the crisper drawer 300 for supporting food items thereon, and walls 304 extending from the base 302 to define a cavity 310 for receiving food items therein. Although the crisper drawer 300 is shown generally as a rectangular shape, any suitable shape with any suitable number of walls is contemplated, and the depiction of a drawer with 4 walls is not intended to be limiting. Furthermore, although the walls 304 are shown as being formed of a single panel, the walls 304 may be modular panels or otherwise separate components that cooperate to form the walls 304. Additionally, although shown as extending from the base 203, the walls 304 may be integrally formed (e.g., molded) with the base 302 in certain embodiments, or be secured or otherwise attached to the base 302 to form the drawer in other embodiments. The crisper drawer 300 also includes a lid 320. Generally, the shelf 115 that is positioned above the crisper drawer 300 acts as the lid 320 for the crisper drawer 300, as shown in FIG. 3. However, in other embodiments (not shown), the crisper drawer 300 may include a separate lid that may selectively provide access to the cavity 310 when open, and help enclose the cavity 310 with the walls 304 and the base 302 when closed. In embodiments where the lid 320 is separate from the shelf above the crisper drawer 300, the lid 320 may be secured to a portion of the crisper drawer (e.g., one or more of the walls 304) via a hinge to allow the lid 320 to pivot relative to the crisper drawer 300 to provide access to the cavity 310 in the open position.

Referring again to FIGS. 3 and 4, according to one or more embodiments, one or more of the base 302, walls 304, and lid 320 (shown as the shelf 115) include a humidity membrane 400, which in some embodiments cooperates with the humidity control system 500, which may include a nanomist system 510 and/or a circulation system (not shown) for the crisper drawer 300. Hereinafter, the humidity membrane 400 will be discussed as being included with the lid 320, however the present disclosure may similarly be applicable to inclusion in the walls and/or base, or inclusion in combinations of the base 302, walls 304, and lid 320 and discussion of the humidity membrane 400 being included with the lid 320 is not intended to be limiting. In the example shown in FIG. 3, the lid 320 (shown as the shelf 115) includes the humidity membrane 400 on a bottom side 325 (i.e., the cavity facing side) of the lid 320. The bottom side 325 of the lid 320 includes a structure 330 defining an opening 335 therein, sized to receive the humidity membrane 400. The humidity membrane 400 is secured within the opening 335 to the structure 330 by interference fit or any suitable mechanical fastener, and depiction of an interference fit between the structure 330 and the humidity membrane 400 is not intended to be limiting. The humidity membrane 400 is secured within the opening 335, and includes a seal 410 around the humidity membrane 400 that limits airflow therethrough to and/or from the cavity 310 of the crisper drawer 300. The seal 410 further limits humidity leakage from the cavity 310 via the area around the humidity membrane 400 (i.e., between the humidity membrane 400 and the structure 330) to support and control the air exchange rate between the crisper drawer 300 and the interior cabinet 120 as desired. The seal 410 may be formed similar to a gasket material, and may include any suitable food-safe material for forming the seal, including, but not limited to neoprene, nitrile (Buna-N), ethylene propylene diene Monomer (EPDM), silicone rubber, flexible PVC, or combinations thereof. By using a gasket material as listed above as the seal 410, air leakage from the crisper drawer 300 can be limited from around the humidity membrane 400. In one or more embodiments, the humidity membrane 400 may include a tab 420 that a user can engage to bring air out from the seal 410 and tighten the seal 410 in the opening 335. The seal 410 can thus allow for removal and resealing of the humidity membrane within the opening 335 in instances of repair or replacement, while inhibiting leakage from the area surrounding the humidity membrane 400.

In various embodiments, the humidity membrane 400 may be selectively removable from the opening 335 by a user, to replace or repair the humidity membrane 400, such that the seal 410 is removed and can be replaced and by a new or repaired humidity membrane 400 with a seal 410 which can seal the opening 335. The bottom side 325 of the lid 320 and structure 330 allows for air within the interior cabinet 120 to flow into and out of the crisper drawer 300 via the humidity membrane 400, but the structure 330 otherwise seals the cavity 310 from airflow when the crisper drawer 300 is closed (as when the drawer is in a closed position within the interior cabinet 120 as in FIG. 2 for the example drawer shown in FIG. 3). As such, although not shown in the Figures, there may be space defined between the structure 330 and the shelf 115 for forming the lid 320 to allow air flow, as the shelf 115 may be constructed of a generally air impermeable material (e.g., tempered glass), while the structure 330 allow the lid 320 to close the top of the cavity 310 against the walls 304. As airflow is generally limited within the interior cabinet 120, and conventional crisper drawers lack any air flow promotion devices, a circulation system (not shown) may facilitate air flow within the cavity 310 when activated at a low setting, and may promote airflow to the humidity membrane 400 and a setting higher than the low setting.

The humidity membrane 400 facilitates control of the humidity level within the crisper drawer 300, while the seal 410 limits air leakage from around the humidity membrane 400. The breakthrough pressure of the membrane 400 is inversely proportional to the pore size, and artificially applied superhydrophobic coatings result in certain leaky modes which in turn limit the effectiveness of conventional humidity membranes. Generally, the humidity membrane 400 is a superhydrophobic membrane with a selective porosity such that the humidity membrane 400, when sealed via seal 410, improves the inhibition of humidity leakage from the crisper drawer 300. The humidity membrane 400 may be any suitable type of membrane, including, but not limited to, a composite ionic membrane including a nanofiber material disposed in a matrix that forms a supporting structure for the nanofiber material. The humidity membrane 400 may further include a base polymer imbibed onto the matrix (e.g., a zeolite), which forms a porous support layer for the nanofibers and base polymer to form the humidity membrane 400. The humidity membrane 400 further has a selective porosity to allow moisture to remain within the crisper drawer 300 as desired and limiting leakage by unwanted leaky modes. For example, the humidity membrane 400 has an average pore size (as based on diameter or other longest dimension) of 100 to 300 microns in some embodiments, 125 to 275 microns in other embodiments, and 155 to 255 microns in yet other embodiments. In some embodiments, the pores are uniformly sized, and in other embodiments, the pore size may vary such that the average pore size is within the above contemplated ranges. The controlled porosity of the humidity membrane 400 and use of food grade adhesive for the seal 410 of the superhydrophobic humidity membrane together can help avoid the unwanted leaky modes from the membrane and therefor help to improve its overall performance within the crisper drawer 300 of an appliance 100.

In embodiments where the humidity membrane 400 is a composite ionic membrane, the nanofiber of the humidity membrane 400 may be a carbon-based nanomaterial, such as, but not limited to, nanotubes, nanoflakes, nanorods, or other nanoparticle carbon-based material. The matrix may be a zeolite material in which the nanofibers are dispersed. The zeolite material may be any suitable zeolite or specialty zeolite, including, but not limited to an aluminosilicate. Although carbon nanomaterial and zeolite material are discussed as options for the nanofiber and the matrix respectively, this is not intended to be limiting, and other materials suitable to provide an ionic membrane for environments with high levels of moisture (i.e., the cavity 310 of the crisper drawer 300) to be maintained at the desired level of humidity.

Although the aim is to limit the leakage of humidity from the humidity membrane 400, the porous nature of the humidity membrane 400 inherently has a leakage rate, however, the seal 410 in combination with the humidity membrane 400 having controlled pore size (e.g., in some embodiments, an average pore size of 155 to 255 microns) can control the humidity level in the crisper drawer 300. As such, the seal 410 inhibits unwanted leakage of the humidity from the crisper drawer 300 when the humidity membrane 400 porosity is optimized.

In various embodiments, the appliance 100 may further include a humidity control system 500. The humidity control system 500 may cooperate with or include a circulation system 510, having one or more low noise fans (not shown) to promote air flow toward the humidity membrane 400 and within the crisper drawer 300 in order to maintain the desired level of relativity humidity inside the crisper drawer 300, as high moisture and humidity levels are desirable to maintain the freshness of the produce within the cavity 310 of the crisper drawer 300. The fan(s) may be sized to occupy minimal volume within the crisper drawer 300 and mix air within and increase airflow across the membrane 400 when activated. In certain examples, each fan of the one or more fans may have a voltage of 12 V, and/or may have a wattage of 2.0 watts. Furthermore, in various examples, the acoustic rating/noise level of each fan may be up to 21 dB. Each of the one or more fans may be individually or collectively (in groups or all) controlled. For example, one or more of the fans may be activated in some embodiments, or all the fans may be activated in other embodiments. Additionally, each fan may have an adjustable speed. As such, the speed of each fan may be adjusted according to the desired moisture production rate as based on a humidity or moisture level sensor 155 within the crisper drawer. Generally, the moisture production rate may increase with fan speed. For example, when the fans are off or set to a low setting, the humidity membrane 400 acts as a moisture barrier, and when the fans are switched on at a high setting, the humidity membrane 400 facilitates retentate formation for humidity control. The fans may be powered by any suitable power source, and may be a wired or wireless fan. In embodiments where the fans are wired, the wires may be incorporated in the crisper drawer 300 body and have extendibility or extend through a wire sized opening (not shown) in the crisper drawer 300 body to allow the wire to reach the fan without inhibiting opening and closing of the crisper drawer 300. In embodiments where the fan is wireless, the fans may be powered by a battery.

The fan(s) of the circulation system 510 may be disposed within the crisper drawer 300 in order to facilitate air flow within the cavity 310 (at a low setting) and across the membrane 400 (at a high setting), and as such, the fan(s) may be mounted to corners 305 between the walls 304 or along one of the walls 304 (as shown in FIG. 4), at a predetermined height along the height of the crisper drawer 300 in order to best point airflow toward the humidity membrane 400. In various embodiments, each fan may be angled towards the humidity membrane 400. In certain embodiments, the predetermined height may be where the fan is closer to the base 302, while in other embodiments, the fan may be closer to the lid 320. In other embodiments, the fan may be positioned at a midpoint between the base 302 and the lid 320 as the predetermined height. In yet other embodiments, although not shown, the at least one fan may be incorporated into or on the base 302 of the crisper drawer 300. In certain embodiments, although not shown, the crisper drawer 300 may include a combination of fans at the corners 305 and in the walls and/or base.

In yet another embodiment, although not shown, the appliance 100 may further include an additional fan (i.e., external fan(s)) outside the crisper drawer 300 and within the interior cabinet 120, as part of the circulation system 510 and positioned to facilitate air flow across the humidity membrane 400 on an outer side of the humidity membrane 400 (i.e., facing the interior cabinet 120, or more particularly, in some embodiments, the bottom surface of the shelf 115). Similar to the fan housed in the crisper drawer 300 described above, the additional fan may draw air out from the crisper drawer cavity 310, and may be a low power, low noise fan sized to occupy minimal volume within the interior cabinet 120. In certain examples, each fan may have a voltage of 12 V. and/or may have a wattage of 2.0 watts. Furthermore, in various examples, the acoustic rating/noise level of the fan may be up to 21 dB. The additional fan may have an adjustable speed, which is adjusted according to the desired moisture production rate based on the humidity measured within the crisper drawer 300. The additional fan may be wired or wireless, as appropriate for inclusion in the interior cabinet 120, and may be similar to the fans disposed in the crisper drawer 300 (i.e., wired or wireless), or may be wired while the internal fans are wireless based on the stationary aspect of the additional fan in the interior cabinet 120.

The one or more fans of the circulation system 510 (i.e., collectively fans within or external to the crisper drawer 300) allow for a selective increase in moisture rate when the one or more fans of the circulation system 510 are actuated. The fans may be selectively activated such that, in embodiments with fans inside the crisper drawer 300 and fans external to the crisper drawer 300, only the internal fans or the external fans are activated, while in other embodiments, both the internal fans and the external fans may be activated. In embodiments where more than one fan is located within the crisper drawer, the fans may be selectively activated based on desired speeds to establish the desired moisture production rate and humidity control. In some embodiments, only certain fans within the crisper drawer 300 may be activated, while others remain inactive. The fans may be selectively activated based on the presence of foodstuffs within the cavity 310, that may inhibit airflow from reaching the humidity membrane 400. As such, each fan may be individually controllable in order to optimize the moisture production rate across the humidity membrane to achieve the desired humidity level within the crisper drawer 300.

As such, the circulation system 510 includes the fans (including one or more internal fans and additional external fans, in some embodiments), a controller 150, and may be controlled by feedback from a combinations of various humidity and/or moisture level sensors 155, door open sensors, various foodstuff presence sensors. As described herein according to various embodiments, the moisture level may be related to the liquid form content, while the humidity level is related to vapor content in the air in the drawer. The moisture level is thus related to misting such that a mist or nanomist device sprays liquid droplets to form moisture.

The humidity control system 500 (and the circulation system 510) may further include and/or cooperate with a mist system 520, or hereinafter interchangeably, nanomist system. The mist system 520 provides a source of moisture production within the crisper drawer 300 in order to maintain the desired level of relativity humidity inside the crisper drawer 300, as high moisture levels are desirable to maintain the freshness of the produce within the cavity 310 of the crisper drawer 300. The mist system 520 may be, in some embodiments, fluidly connected with the water line (not shown) or may be fluidly connected to one or more water reservoir(s) 530 that can be filled by a user, forming a mist system 520 independent of other features and operations of the appliance 100. The water supplied to the mist system 520 either from the water line or a corresponding water reservoir, is supplied to a device that produces and/or sprays a moisture mist or nanomist to promote freshness of the produce stored in the cavity 310. Although the mist system 520 is shown as having separate water reservoirs 530, this is not intended to be limiting, and the humidity control system 500 may include a shared separate water reservoir fluidly connected to the mist system 520, either internal to the crisper drawer 300 or external such that the water is supplied via a tubing or pipes.

In certain embodiments, the circulation system 510 being activated allows mixing of the air within the cavity 310 and further generates moisture for mixing into the air in the crisper drawer 300 because the humidity membrane 400 allows the retentate liquid or concentrated vapor to remain within the crisper drawer 300 via pervaporation to facilitate a high humidity environment in the cavity 310 when the circulation system 510 is activated. Thus, the humidity membrane 400 and the humidity control system 500 (including either or both of the circulation system 510 in and the mist system 520) allow for moisture to be produced or fed to the food stored in the crisper drawer 300, as the circulation system 510 can artificially circulate air within the cavity 310 (when actuated at a first setting), and force air to pass through the humidity membrane 400 (when actuated at a second setting, higher than the first setting) to leave retentate moisture within the cavity 310 to control the relative humidity therein. Meanwhile, the mist system 520 can produce moisture within the crisper drawer cavity 310 when the humidity level drops below a predetermined moisture threshold. Thus, the humidity control system 500 facilitates preservation of the foodstuffs in the crisper drawer 300, while the seal 410 facilitates moisture retention within the crisper drawer 300.

Referring again to FIGS. 3 & 4, the humidity membrane 400 cooperates with the humidity control system 500, and the circulation system 510 and mist system 520, to improve shelf life and preserve food items placed within the cavity 310 of the crisper drawer 300. The seal 410 formed by and around the humidity membrane 400 further allows the humidity control system 500 to better control the air exchange rate and moisture production rate to control the humidity within the crisper drawer 300. According to various embodiments, the humidity membrane 400 and the humidity control system 500 may control the humidity level within the crisper drawer 300 to be at least 55%, and in other embodiments, at least 60%. Generally, a first threshold humidity level may be designated such that the circulation system 510 operates at a first setting to mix air within the cavity 310. A second threshold humidity level may be designated such that the circulation system 510 operates at a second setting (higher than the first) to force airflow across the humidity membrane 400 and form retentate moisture on the cavity facing side of the humidity membrane 400 for mixing into the air within the cavity 310 and increasing the humidity level. Furthermore, if the moisture within the cavity 310 drops below a predetermined moisture threshold, the mist system 520 may be activated to produce moisture within the crisper drawer. The activation of the mist system 520 may be independent of the circulation system 510 in some embodiments, or may be related in other embodiments. In embodiments where the activation is independent, the humidity and/or moisture level sensors 155 may individually provide values for comparison to the humidity and moisture thresholds for each of the circulation system 510 and the mist system 520. In embodiments where the activation is related, the activation of the mist system 520 may in turn activate the circulation system 510 at a mist setting to facilitate circulation and spray of the moisture. In yet other embodiments where the activation is related, the activation of the circulation system 510 may in turn activate the mist system 520 at a humidity setting to facilitate achieving the desired humidity within the cavity 310. Thus, although the components of the humidity system may be described as separately activated, the components may be interconnected such that they cooperate to optimize the humidity and moisture in the crisper drawer.

Figure 5:
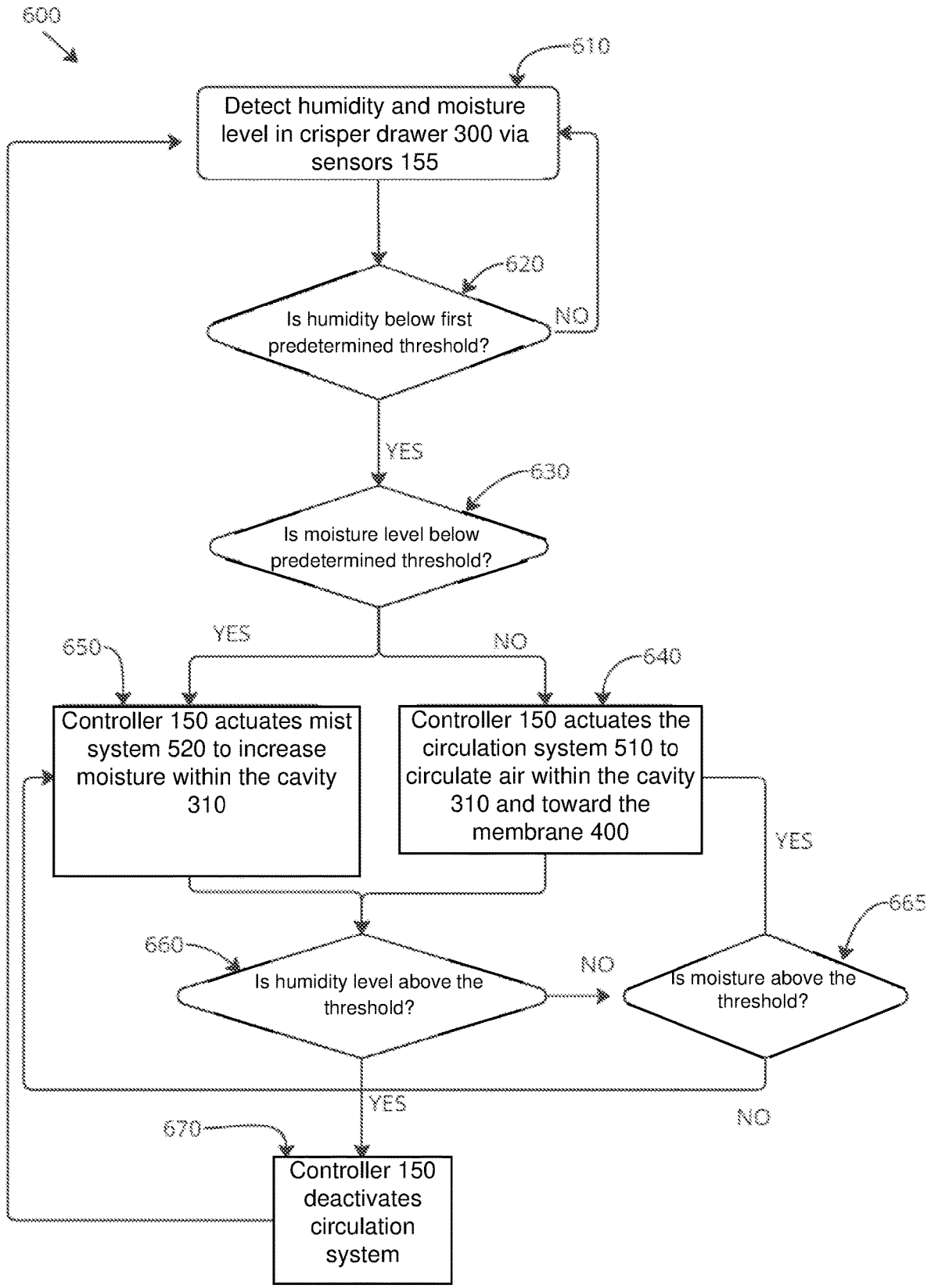
FIG. 5 is a flow chart of control logic for a humidity control system, according to one or more embodiments.

As shown in FIG. 5, an example of the system control logic 600 for the humidity control system 500 is shown. Notably, the example control logic 600 is for a system having both a circulation system 510 and a mist system 520 that are related, however other embodiments where the systems are independently activatable and/or operable in a different order (i.e., the moisture level may be checked first) are also contemplated. The humidity and moisture level sensors 155 detect the humidity and moisture level within the crisper drawer 300 at step 610. The humidity level is then compared with a humidity threshold, at step 620, and the moisture level is compared with a moisture threshold, at step 630. Responsive to indication from the sensor 155 that the humidity level in the cavity 310 of the crisper drawer 300 is below the threshold (e.g., 65% in some embodiments) and that the moisture level is below the predetermined moisture threshold, the controller 150 activates the mist system 520 to increase moisture production in the cavity 310, as shown at step 650. The fans 510 activated may be a combination of one or more of the internal fans 512 and/or the additional fans in the interior cabinet. The controller 150 may adjust each fan speed based on the humidity sensors 155, as well as the foodstuff presence sensors in order to optimize the airflow to control the humidity level within the crisper drawer. At step 640, responsive to indication from a humidity sensor 155 that the humidity level in the cavity 310 of the crisper drawer is below the predetermined threshold, but the moisture level is above a moisture threshold, the controller 150 activates the circulation system 510 to circulate air within the cavity and toward the membrane 400 to regulate humidity within the crisper drawer 300. In certain further embodiments, the humidity level may be compared with a first threshold humidity and a second threshold humidity, lower than the first, and the circulation system 510 may be activated at a different setting based on the threshold below which the measured humidity level falls.

At steps 660 and 665, the system monitors the humidity level and moisture levels via sensors 155 to detect whether the humidity level and moisture levels have increased above their respective thresholds. If so, the controller 150 deactivates the circulation system 510 at step 670, and the system restarts at step 610. If the humidity level is not met at step 660 and the moisture level is above the threshold, as checked at step 665, the system returns to step 640 to operate the circulation system 510. If the moisture level has not increased, the system returns to step 650 to operate the mist system 520. Although not shown on the logic, activation of the mist system 520 may also correspond to activation of the circulation system to promote moisture spray from the mist system 520, however, the circulation system 510 may be independently activatable without activation of the mist system 520 in the logic of FIG. 5 to promote circulation.

In various embodiments, although not shown in the example control logic of FIG. 5, when the foodstuffs sensors detect a high volume of food in the crisper drawer 300, the controller 150 may activate the circulation system 510 at a higher speed than when the crisper drawer is empty, in order to provide a sufficient air flow at the humidity membrane. The controller 150 may further activate the mist system 520 in order to meet the desired moisture production rate. In other embodiments, the circulation system 510 and/or the mist system 520 may be activated on a calendar or time interval schedule in order to maintain an acceptable humidity range and moisture level within the crisper drawer 300. The schedule may be adjusted based on the times the door is open throughout the day (door open sensors) or based on active readings from the sensors 155 within the crisper drawer. In certain embodiments, the controller 150 may employ artificial intelligence to develop a calendar for controlling the humidity control system 500 or adjust fan speeds and mist timing and quantity as based on the user's schedule and typical contents/produce and volume usage of the crisper drawer. As such, the circulation system 510 may utilize various types of sensors other than the sensors 155 with the controller 150 to optimize the performance of the humidity membrane 400, and employ learning technology to customize the humidity control based on the user.

In one or more embodiments, if the humidity level in the crisper drawer falls remains below the predetermined threshold level, but the moisture level has exceeded past the threshold, the circulation system 510 may activate (at step 640) to force airflow across the humidity membrane 400 to move moisture around the crisper drawer increase the humidity level within the crisper drawer. The moisture produced by the mist system 520 is thus circulated by artificially produced airflow such that air passes through the humidity membrane, leaving moisture behind, and this moisture can be further mixed into the air and spread within the cavity 310. The circulation system 510 may be activated at different settings as based on the humidity level as related to the threshold levels.

In one or more embodiments, when the humidity level and/or moisture level in the crisper drawer is within the desired range (i.e., above the respective thresholds), the humidity control system 500 (i.e., circulation system 510 and mist system 520) may be deactivated, and the fans and mist device can be switched off by the controller 150. The circulation system 510 and the mist system 520 may also be manually activated or switched off. For example, if the user finds the the surface of the produce stored in the drawer to be dry, the user can activate the mist system 520. In other examples, if the user finds the fan to be noisy when accessing contents of the crisper drawer 300, the user may be able to switch off the fan. In other embodiments, opening of the crisper drawer or opening of the refrigerator cabinet may prompt the controller to deactivate the circulation system 510 and/or the mist system 520. In certain other embodiments, if the user opens the crisper drawer and sees moisture pooling in the drawer, the user may manually activate the fans to facilitate humidity control within the crisper drawer when the moisture level has become too high.

As such, the circulation system 510 and mist system 520 can facilitate humidity and moisture control within a desired range, increasing the levels as based on the thresholds for adequate levels within the crisper drawer (e.g., at least 55% humidity, or in other examples, at least 60% humidity), as shown in the example control logic of FIG. 5. The sensors and machine learning that cooperate with a controller of the humidity control system 500 may be tuned to increasing humidity and moisture, decreasing humidity and moisture, or both, and discussion of any particular implementation is not intended to be limiting.

According to various embodiments, although not shown, the humidity membrane 400 may further include a coating thereon to improve moisture retention within the crisper drawer 300. The coating may be disposed on the cavity 310 facing side of the humidity membrane 400. The coating may further be uniformly disposed on the humidity membrane 400 and coat the entire surface of the humidity membrane 400. The uniform deposition of the coating may be defined by the thickness of the coating varies by under, in some embodiments, 0.5 to 500 microns, across points along the coating. In certain embodiments, the coating may be a hydrophilic coating which holds moisture thereon for retention within the crisper drawer 300 and for facilitation of moisture control via the circulation system 510 when the humidity within the crisper drawer 300 needs to be raised. In other embodiments, the coating may be a hydrophobic coating which rejects moisture back into the cavity 310. Although described as a coating, the coating material may in various embodiments be blended into the material of the humidity membrane 400 to cooperate with the nanofibers dispersed in the matrix to provide the properties as described above, and discussion of a coating on the humidity membrane 400 is not intended to be limiting.

Thus, according to one or more embodiments, an appliance includes a crisper drawer that includes a humidity membrane for inhibiting moisture permeation therethrough, and sealing the humidity membrane to retain moisture in the crisper drawer. The seal of the humidity membrane, along with a selective porosity, limit humidity leakage from the crisper drawer cavity to the interior of the appliance. The appliance also includes a humidity control system which cooperates with the humidity membrane. The humidity control system includes a circulation system and/or a mist system. The circulation system facilitates airflow toward the humidity membrane and within the crisper cavity, while the mist system produces moisture within the cavity and on the surface of foodstuffs within the cavity to increase the moisture level in the crisper drawer. The circulation system includes one or more fans to mix air within the crisper drawer at a first setting, and direct airflow to the humidity membrane, and facilitates establishing a moisture production rate with the mist system. The circulation system and/or mist system may be activated based on various sensors (e.g., humidity and moisture sensors), data (e.g., contents of the crisper drawer), or a schedule, or combinations thereof, and may further incorporate machine learning to activate the humidity control system.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An appliance comprising:

a housing defining an interior cabinet;

a crisper drawer disposed within the interior cabinet, the crisper drawer including a base, walls, and lid to define a cavity for receiving food items to be stored in the crisper drawer, the lid selectively closing the crisper drawer to limit air flow to and from the cavity, one or more of the base, the walls, and the lid defining an opening and including a humidity membrane disposed within the opening, the humidity membrane including a seal therearound for sealing the opening;

a mist system including a mist device and a water source, the mist device being disposed in the crisper drawer to produce moisture from the water source within the crisper drawer;

a circulation system cooperating with the humidity membrane, the circulation system including one or more fans disposed within the crisper drawer to selectively facilitate air flow across the humidity membrane and mix air within the cavity to control a humidity level within the crisper drawer; and a controller configured to, responsive to a moisture level within the crisper drawer falling below a predetermined moisture level, actuate the mist system to draw water from the water source and generate mist at the mist device to increase moisture levels within the crisper drawer, responsive to the humidity level within the crisper drawer falling below a predetermined humidity level, actuate the one or more fans to promote air flow toward the humidity membrane to increase the humidity level in the crisper drawer, and responsive to the humidity level within the crisper drawer falling below the predetermined threshold humidity level and the moisture level within the crisper drawer exceeding the predetermined moisture level, actuate only the circulation system to mix air within the crisper drawer to raise the humidity level above the predetermined threshold humidity level, wherein the seal of the humidity membrane retains moisture and limits leakage of humidity from the crisper drawer.

2. The appliance of claim 1, wherein the seal is formed of a gasket material.

3. The appliance of claim 2, wherein the gasket material is a food-safe neoprene, nitrile (Buna-N), ethylene propylene diene Monomer (EPDM), silicone rubber, flexible PVC, or combinations thereof.

4. The appliance of claim 1, wherein the predetermined humidity level is 55% humidity.

5. The appliance of claim 1, wherein the humidity membrane is a porous membrane having an average pore size of 100 to 300 microns.

6. A compartment of an appliance comprising:

a base, walls, and lid to define a cavity for a crisper drawer for receiving food items to be stored in the crisper drawer, the lid selectively closing the crisper drawer to limit air flow to and from the cavity, one or more of the base, the walls, and the lid defining an opening and including a humidity membrane disposed and sealed within the opening, the humidity membrane including a seal therearound for sealing the opening;

a circulation system including at least one fan disposed within the crisper drawer to facilitate air flow within the cavity and across the humidity membrane to selectively control a humidity level within the crisper drawer; and a mist system including a mist device and a water source fluidly connected to the mist device, the mist device disposed within the cavity of the crisper drawer, wherein the mist device produces a moisture spray from water from the water source to increase a moisture level within the crisper drawer, and responsive to the humidity level within the cavity of the crisper drawer falling below a predetermined threshold humidity level and the moisture level falling below a predetermined moisture level, a controller actuates the circulation system and the mist system to form the moisture and humidify the air within the crisper drawer, and responsive to the humidity level within the crisper drawer falling below a predetermined threshold humidity level and the moisture level exceeding the predetermined moisture level, the controller actuates only the circulation system to mix air within the crisper drawer to raise the humidity level above the predetermined threshold humidity level.

7. The compartment of claim 6, wherein mist is generated within the crisper drawer from water provided at the water source.

8. The compartment of claim 6, wherein the moisture level is related to water content in liquid form within the crisper drawer.

9. The compartment of claim 6, wherein the seal is formed of a gasket material.

10. The compartment of claim 9, wherein the gasket material is a food-safe neoprene, nitrile (Buna-N), ethylene propylene diene Monomer (EPDM), silicone rubber, flexible PVC, or combinations thereof.

11. A system for controlling humidity within a crisper drawer of an appliance, the system comprising:

a humidity membrane sealed by a seal in an opening of a body of the crisper drawer, the humidity membrane facilitating air flow from a cavity of the crisper drawer to an interior cabinet of the appliance and the seal limiting humidity leakage from the opening;

a circulation system disposed within the cavity of the crisper drawer, the circulation system including a fan configured to promote air flow within the cavity when actuated;

a mist system disposed within the cavity and in fluid communication with a water source, the mist system including a mist device to produce a moisture spray in the cavity; and a controller configured to actuate the circulation system and promote air flow responsive to a humidity level within the crisper drawer, and actuate the mist system and produce moisture responsive to a moisture level within the crisper drawer, wherein when the humidity level is below a threshold humidity level and the moisture level is below a threshold moisture level, the controller actuates both the circulation system and the mist system to increase the humidity level and moisture level, respectively, and when the moisture level within the crisper drawer is above the threshold moisture level, and the humidity level is below the threshold humidity, the controller deactivates the mist system and continues operation of the circulation system.

12. The system of claim 11, wherein when the humidity level is below a first humidity threshold, the fan is actuated at a first setting, and when the humidity level is below a second humidity threshold, higher than the first, the controller actuates the fan at a second setting, lower than the first setting.

* * * * *